US007175109B2

(12) United States Patent
Schroeder et al.

(10) Patent No.: US 7,175,109 B2
(45) Date of Patent: Feb. 13, 2007

(54) DOUBLE-SWIRL SPRAY NOZZLE

(75) Inventors: Thomas Schroeder, Bad Urach (DE); Juergen Speier, Reutlingen (DE)

(73) Assignee: Lechler GmbH, Metzingen (DE)

( * ) Notice: Subject to any disclaimer, the term of this patent is extended or adjusted under 35 U.S.C. 154(b) by 16 days.

(21) Appl. No.: 10/872,817

(22) Filed: Jun. 21, 2004

(65) Prior Publication Data

US 2005/0017093 A1 Jan. 27, 2005

(30) Foreign Application Priority Data

Jun. 21, 2003 (EP) ..... 03014004

(51) Int. Cl.
*B05B 1/34* (2006.01)

(52) U.S. Cl. ..... 239/468; 239/463; 239/477; 239/548; 239/565

(58) Field of Classification Search ..... 239/461, 239/463, 468, 477, 548, 565, 487
See application file for complete search history.

(56) References Cited

U.S. PATENT DOCUMENTS 545,320 A 8/1895 Van Sickle
1,156,474 A * 10/1915 Gifford ..... 239/477
2,484,577 A * 10/1949 Murphy ..... 239/468
6,322,617 B1 11/2001 Wurz et al.
6,772,960 B2 8/2004 Speier

FOREIGN PATENT DOCUMENTS

FR 882 080 5/1943
GB 969 594 9/1964

* cited by examiner

*Primary Examiner*—Steven J. Ganey
(74) *Attorney, Agent, or Firm*—Flynn, Thiel, Boutell & Tanis, P.C.

(57) ABSTRACT

A double-swirl spray nozzle includes two swirl chambers which are connected to a common supply channel which extends in a central plane between the swirl chambers. Both swirl chambers have outlet openings which open outwardly from the supply channel to the same side. The axes of the swirl chambers are furthermore inclined at an angle with respect to one another. Thus with one single compact spray nozzle it is possible to create atomizing cones with a very large impact area which mutually overlap on the side facing one another and in spite of the speed component unidirected in the overlapping area result in a secondary division of the liquid droplets in the two atomizing cones, which increases the efficiency when the nozzle is utilized in so-called gas washers for cleaning purposes.

6 Claims, 2 Drawing Sheets

DOUBLE-SWIRL SPRAY NOZZLE

FIELD OF THE INVENTION

The invention relates to a double-swirl spray nozzle comprising two swirl chambers for producing spray jets with oppositely directed swirl and comprising a common supply channel which extends around a central plane between the swirl chambers, and terminates tangentially into the swirl chambers.

BACKGROUND OF THE INVENTION

A double-swirl spray nozzle of this type is known from the DE 100 33 781 C1. Nozzles of this type are utilized in particular, as also other double-swirl spray nozzles according to the DE 197 58 526 A1, mainly for so-called gas washers, where a washing liquid is supplied over a plurality of spray nozzles distributed as evenly as possible in the gas flow over the cross section of the conduit therefor. Such gas washers may, for example, be flue-gas cleaning systems, where sour flue-gas parts like sulfur dioxide, chlorine or hydrogen fluoride and to a small degree also flue-gas dust are separated with the use of suitable washing liquids. The advantage of the above-mentioned double-swirl nozzles is thereby that the swirling action of the supplied washing liquid is mutually cancelled so that an undesired influence on the flow in the gas washer can be avoided. This results in a higher efficiency.

The nozzles in such gas washers are distributed over several planes, whereby the gas in the gas washers flows usually from below upwardly and the atomized medium falls downwardly, thus against the gas flow. The aforementioned double-swirl spray nozzles according to the DE 100 33 781 C1 are utilized in the lower area, whereas in the upper area eccentric nozzles spraying only to one side, thus downwardly are provided in order to avoid that spraying into the droplet separator provided at the upper end of gas washers, in particular flue-gas desulfurizing systems, occurs.

Such eccentric nozzles have as a rule the following disadvantages: Since often the same volume flow as in the double-swirl spray nozzles in the lower area is desired, same must now be sprayed through a swirl chamber (mouth piece); this coarsens the droplet spectrum, which can have a negative affect on the process. If one wants to maintain the droplet spectrum constant and therefore cut the volume flow per nozzle in half, then one must place twice as many nozzles, which can result in high costs (fastening means, installation, pipe connections). Since the swirl direction of all eccentric nozzles is the same, a swirl acts on the gas flow, which, as above indicated, can have a negative affect on the cleaning process.

The purpose of the invention is to provide a double-swirl spray nozzle of the above-identified type in such a manner that a spray jet is possible only to one side in spite of a swirl cancellation and yet enabling a large surface to be covered with the spray jets.

To attain this purpose it is provided that both swirl chambers are open to the same side. It has thereby been surprisingly discovered that in this case, due to the common supply channel for the side-by-side lying swirl chambers, already shortly after an exiting of the medium from the swirl chambers mutually overlapping spray jets do not lead to any disadvantageous formation of the spray fan being created. Since the droplets of the directly adjacent atomizing cones being created hit one another quasi unstopped due to the small spacing between the swirl chambers, the oppositely directed radial speed of the droplets results in such an impact that the droplets burst open and thus the droplet spectrum becomes finer. This effect indeed also exists in traditionally arranged nozzles having a spacing of 700 to 1200 mm from one another, however, because of the radial speed being slowed down by the air resistance, the effect is no longer so distinct. Therefore, a droplet spectrum is created by the invention which contributes to an improved efficiency. Since the swirl chambers themselves must be designed only for half of the volume flow, the length of, and thus also the moments acting onto, the nozzle connection can be reduced. The axes of the swirl chambers extend at an angle to one another and diverge toward the outlet openings. This embodiment enables an enlargement of the surface covered by the spray jets. The danger of untreated gas moving through the washer is thus reduced. The new double-swirl spray nozzle is very compact and efficient. It has been shown that when the angle of adjustment of the axes of the swirl chambers is approximately 20°, a particularly advantageous spray-jet formation can be achieved.

BRIEF DESCRIPTION OF THE DRAWINGS

The invention is illustrated in the drawings in connection with one exemplary embodiment and will be discussed hereinafter. In the drawings.

DETAILED DESCRIPTION

Figure 1:
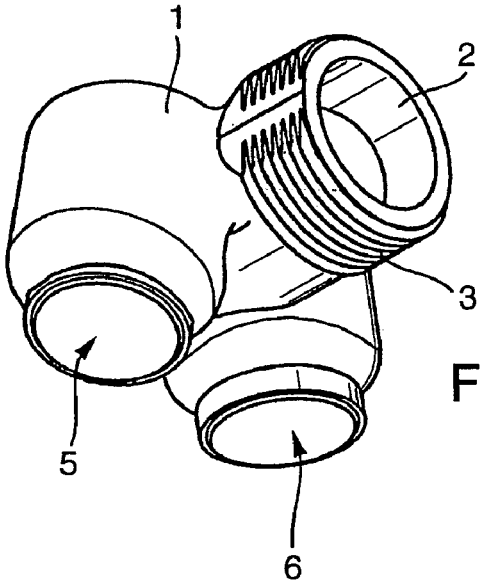
FIG. 1 is a perspective illustration of a novel double-swirl spray nozzle.
Figure 2:
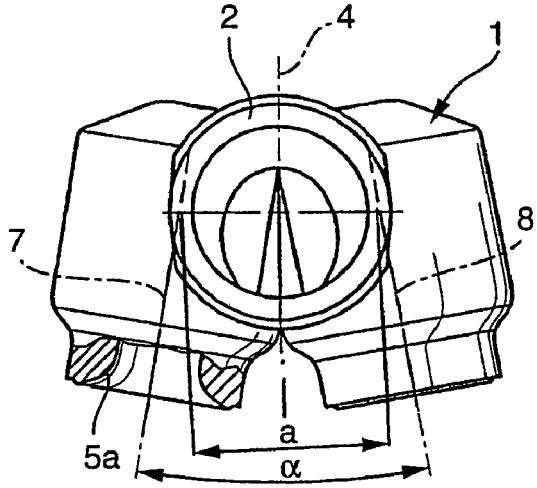
FIG. 2 is a view of the nozzle according to FIG. 1 from the side of the feed connection.
Figure 3:
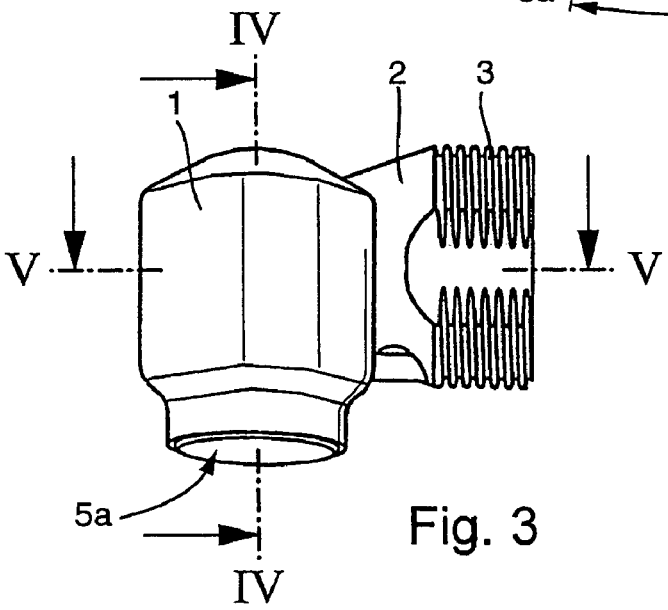
FIG. 3 is a side view.

FIGS. 1 to 3 show that the novel double-swirl spray nozzle has a compact housing 1 with a connection piece 2 having an external connection thread 3 configured to be screwed to a connection nut of a not illustrated supply pipe. The housing 1 encloses two cylindrical swirl chambers 5 and 6 which are each constructed mirror-symmetrically relative to a central plane 4 visible in FIG. 2. The interior of each swirl chamber transitions into trumpet-like constructed outlet openings 5*a*, 6*a*. The axes 7 or 8 of the swirl chambers 5 and 6 are inclined with respect to one another at an angle $\alpha$, which is 20° in the exemplarily embodiment.

Figure 5:
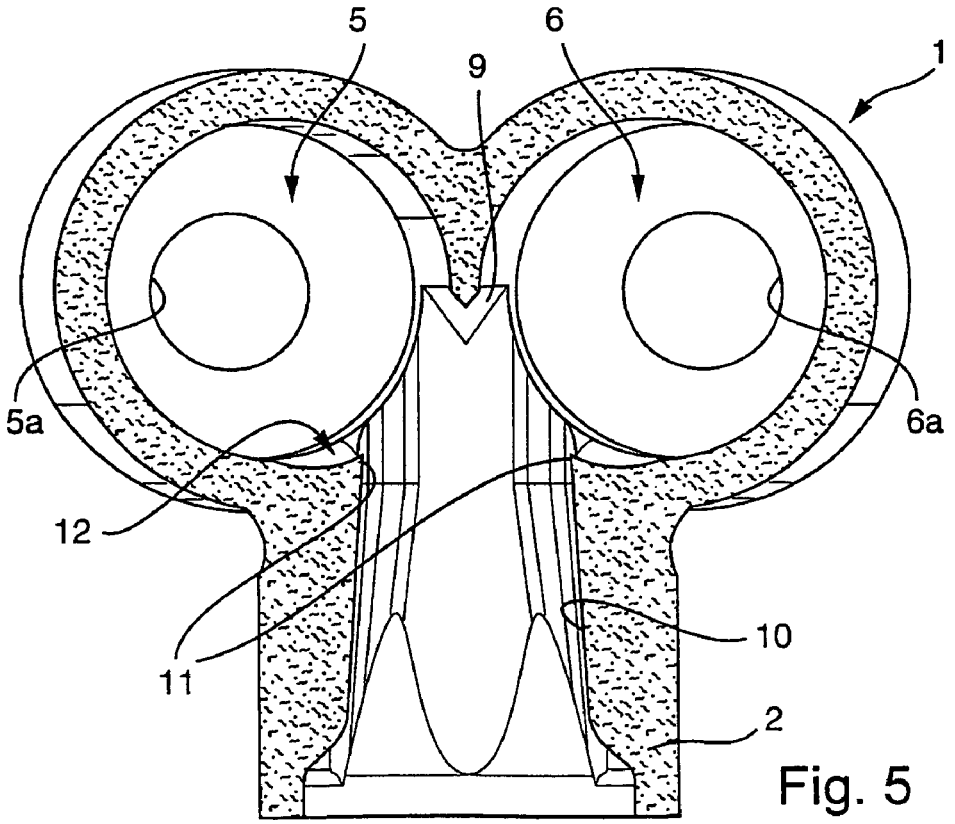
FIG. 5 is a cross-sectional view of the spray nozzle taken along the cross-sectional line V—V in FIG. 3.

FIG. 5 shows that the supply channel 10 of the connection piece 2 transfers without any significant cross-sectional restriction into the two swirl chambers 5 and 6, which both are open toward the same side. The incoming jet of the utilized liquid medium supplied through the connection piece 2, which medium depending on its use is selected for the respective gas washer, hits a centrally oriented blade 9 opposing the flow direction. The jet is therefore divided into two parts, one of which is introduced from the right through the swirl chamber 6 and the other one from the left into the swirl chamber 5. The spray-jet then exits in the form of an atomizing cone to the same side through the outlet openings 5*a*, 6*a*. The supply channel 10 transfers on a side remote from the blade 9 behind an edge 11 into the respective swirl chamber 5 and 6, where it forms a blend with the associated swirl chamber. Reference numeral 12 identifies fillings, which are needed from a technical aspect for manufacture, in order to guarantee a manufacturability, especially an ability to be released from a mold. The two spray jets have an oppositely directed swirl and overlap in the area where they face one another. There it is possible, in spite of the unidirected speed vectors acting in peripheral direction because of the oppositely directed radial speed, for a secondary division of the liquid droplets created in the spray jet to occur, as has already been mentioned above, which has a positive effect on the efficiency of the gas cleaning process.

Since the two swirl-chamber axes 7 and 8 are inclined at an angle with respect to one another, the size of the overlapping area of the two atomizing cones can be influenced and it has been discovered that at a chosen angle α of approximately 20° a particularly good droplet distribution in the double-spray jet occurs. Also the entire spray-jet area is enlarged through the inclination of the axes relative to one another so that also the contact area with the gas to be cleaned is enlarged.

Figure 4:
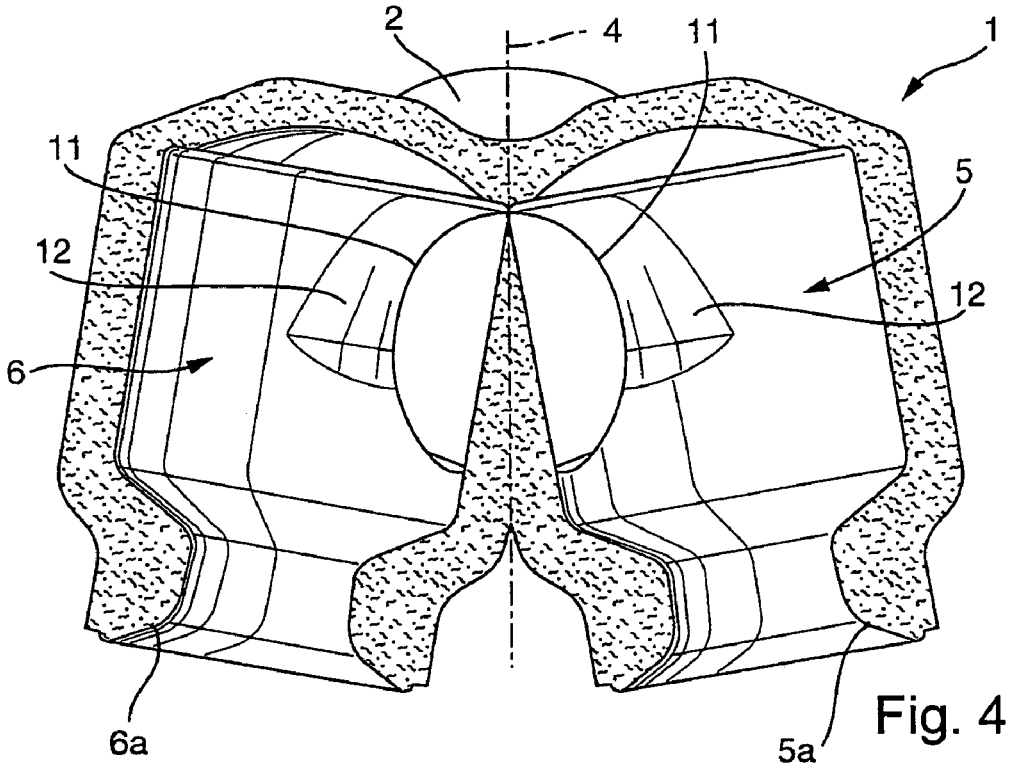
FIG. 4 is a cross-sectional view of the spray nozzle taken along the cross-sectional line IV—IV in FIG. 3.

The illustrations of FIG. 2, of FIG. 4 and of FIG. 5 show that the flow channel 10 starting out from its connection piece 2 transitions with respect to its cross-sectional form from a circular cross section in the area of the connection piece 2 to a slightly elliptic form in the port area into the two swirl chambers 5, 6. As has already been discussed, no significant cross-sectional contraction occurs thereby, however, there then exists in the transition area of the supply channel 10 into the two swirl chambers 5, 6 a cross-sectional form of the supply channel 10 where a maximum cross-sectional dimension parallel to the central plane 4 is longer than a maximum cross-sectional dimension perpendicular thereto. It has been found that with this slightly elliptic cross-sectional form in the transition area a good flow into the two swirl chambers 5, 6 results.

The views of FIG. 2 and of FIG. 4 show furthermore that the blade 9 has a form triangular in cross section when viewed perpendicular to the central plane 4, whereby, viewed parallel to the central plane 4, the angle between the side surfaces of the triangle corresponds with the angle α between the swirl-chamber axes 7, 8. FIG. 5 shows that the blade 9, in the area which faces the liquid flowing in through the supply channel 10, is designed comparatively blunt, namely, the angle between the two side surfaces which oppose the supply channel 10 is chosen relatively large and in the illustrated embodiment lies in the vicinity of approximately 80°. This corresponds to an angle of 40° that each side surface defines with a center axis of the flow channel 10. It has been proven that such an angle between the two side surfaces of the blade 9, with which the in-flowing liquid is divided into the two swirl chambers 5, 6, enables a good flow distribution in the housing 1 and moreover can be easily accomplished from a technical aspect of manufacture and has little or no sensitivity during operation.

The side surfaces of the blade 9 transfer on their side remote from the supply channel 10 into the cylindrical inner walls of the swirl chamber 5, 6, whereby, as can be seen in FIG. 5, there exists an edge at the transition area. In spite of the thus not stepless transfer from the side surfaces of the blade 9 into the side walls of the swirl chambers 5, 6 good flow ratios are achieved.

The illustration of FIG. 4 shows further that the swirl chambers inclined at an angle with respect to one another have a convex base at an end opposite the respective outlet opening 5*a*, 6*a*. Between a circular-cylindrical inner wall of the swirl chambers 5, 6 and the respective base arched outwardly from the swirl chamber 5, 6, there is provided in addition a circular-annularly-shaped step so that the initial diameter of the convex base is smaller than the diameter of the cylindrical inner wall of the swirl chambers 5, 6. The swirl chambers 5, 6 inclined at an angle α with respect to one another communicate with one another thus merely in the area of their annular step, not, however, in the area of their convex bases. Thus the convex bases of the swirl chambers 5, 6 are followed first by the annular step and then the cylindrical inner wall arranged perpendicularly with respect to this annular step. Near the outlet openings, the cylindrical inner wall transfers then with a transition radius into a tapering part of the swirl chambers 5, 6. The view of FIG. 4 shows thereby that the contour of the swirl chambers 5, 6 extends first rounded inwardly and then the sign of the curvature changes in order to transfer into the most narrow part and to then transfer into the outlet opening 5*a*, 6*a*, which opens outwardly in a trumpet-shaped form.

Thus it is now possible to achieve with the invention merely by installing one single nozzle a spray-jet widening and an interaction of the mutually overlapping atomizing cones having varying swirls, which has advantageous effects on the cleaning efficiency.

What is claimed is:

1. A double-swirl spray nozzle comprising: two swirl chambers for producing spray jets with oppositely directed swirl, a common supply channel, which extends around a central plane between the swirl chambers, and terminates tangentially into the swirl chambers, whereby outlet openings of both swirl chambers point toward the same side, wherein axes of the swirl chambers extend at an angle (α) with respect to one another, which angle diverges toward the outlet openings and wherein at least in a transition area of the supply channel into the swirl chambers a maximum cross-sectional dimension parallel to the central plane and a maximum cross-sectional dimension perpendicular thereto are different, whereby a cross-sectional form of the supply channel is noncircular.

2. The double-swirl spray nozzle according to claim 1, wherein the swirl chambers are constructed mirror-inverted with respect to the central plane.

3. The double-swirl spray nozzle according to claim 1, wherein the axes of the swirl chambers are arranged side-by-side at a distance (a) in the area of the supply channel, which distance lies in the order of magnitude of the diameter of a swirl chamber.

4. The double-swirl spray nozzle according to claim 1, wherein the angle (α) is approximately 20°.

5. The double swirl nozzle according to claim 1, wherein the maximum cross-sectional dimension parallel to the central plane is greater than the maximum cross-sectional dimension perpendicular thereto.

6. The double-swirl spray nozzle according to claim 1, wherein at least in the transition area of the supply channel into the swirl chambers, the cross-sectional form of the supply channel is elliptical.

* * * * *